US005592838A

United States Patent [19]

Clark et al.

[11] Patent Number: 5,592,838

[45] Date of Patent: Jan. 14, 1997

[54] ANTI-ATTACK INTERLOCKS FOR A COMBINATION LOCK MECHANISM

[75] Inventors: Thomas R. Clark; Gerald L. Dawson; Paul T. Scherer, all of Lexington, Ky.

[73] Assignee: Mas-Hamilton Group, Lexington, Ky.

[21] Appl. No.: 839,174

[22] Filed: Feb. 20, 1992

[51] Int. Cl.[6] ..... E05B 49/02

[52] U.S. Cl. ..... 70/303 A; 70/278; 70/333 R; 292/251.5

[58] Field of Search ..... 70/1.5, 1.7, 150, 70/276–279, 303 A, 303 R, 333 R, 321, 322, 416, DIG. 10, DIG. 26, 153; 292/DIG. 66, 251.5

[56] References Cited

U.S. PATENT DOCUMENTS

| | | | |
|---|---|---|---|
| 686,073 | 11/1901 | Hollar et al. | 70/278 |
| 2,575,674 | 11/1951 | Miller | 70/333 R |
| 2,807,954 | 10/1957 | Miller | 70/333 R |
| 3,705,739 | 12/1972 | Adler | 292/DIG. 66 X |
| 3,811,717 | 5/1974 | Floyd et al. | 292/DIG. 66 X |
| 3,906,761 | 9/1975 | Swaim | 70/333 R |
| 4,106,316 | 8/1978 | Tippin | 70/333 R X |
| 4,222,251 | 9/1980 | Uyeda | 70/1.5 |
| 4,532,785 | 8/1985 | Uyeda | 70/1.5 X |
| 4,671,087 | 6/1987 | Olenfalk et al. | 70/283 |
| 4,831,851 | 5/1989 | Larson | 70/303 A |
| 4,904,984 | 2/1990 | Gartner et al. | 70/333 R X |
| 4,967,577 | 11/1990 | Gartner et al. | 70/303 A X |
| 5,121,950 | 6/1992 | Davidian | 292/DIG. 66 X |
| 5,257,519 | 11/1993 | Miller, III | 70/303 A |
| 5,271,253 | 12/1993 | Cassada et al. | 70/276 |
| 5,307,656 | 5/1994 | Gartner et al. | 70/277 |
| 5,487,290 | 1/1996 | Miller et al. | 70/303 A |

FOREIGN PATENT DOCUMENTS

| | | | |
|---|---|---|---|
| 2447439 | 9/1980 | France | 292/DIG. 66 |
| 3817696 | 11/1989 | Germany | 70/277 |
| 815654 | 7/1959 | United Kingdom | 70/303 A |

OTHER PUBLICATIONS

English Translation of Germany 3,817,696.

*Primary Examiner*—Suzanne L. Dino
*Attorney, Agent, or Firm*—Laurence R. Letson

[57] ABSTRACT

Interlocks are described that prevent the bolt of a bolt lock from being displaced to the unlocked position by the use of impact and inertial of the lock parts, heat and the displacement of the cover plate of the lock housing.

15 Claims, 3 Drawing Sheets

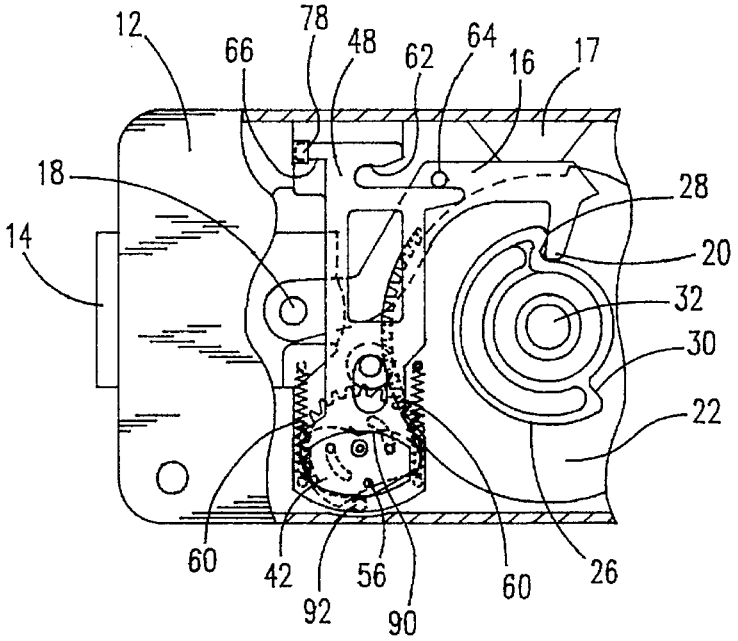
FIG. 3
FIG. 4
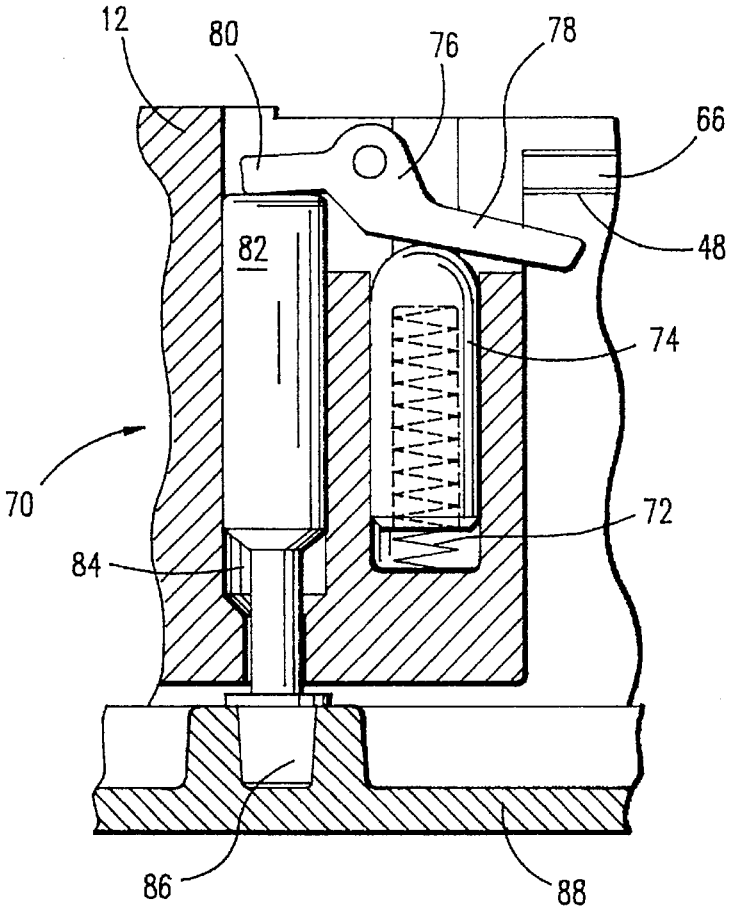

ANTI-ATTACK INTERLOCKS FOR A COMBINATION LOCK MECHANISM

FIELD OF THE INVENTION

This invention relates to the field of combination locks and, more particularly, to interlocks that will prevent the opening of the lock by the use of heat such as a cutting torch, use of impact to dislodge the elements of the lock mechanism from a locked position to an unlocked position which then would permit the opening of the locked enclosure, or the partial removal or displacement of the lock cover permitting access to the inner works of the lock.

BACKGROUND OF THE INVENTION

To secure the enclosure of safes and vaults, a combination lock is attached to the door of the enclosure. Some vaults and safes are small enough to be elevated and dropped, which could cause some of the elements of the lock mechanism to realign or shift position. At least momentarily, the parts of the lock mechanism would be in a position to allow the opening of the lock, not withstanding the fact that it has not been unlocked by dialing. If the dial is operated at the moment the elements are so positioned, the lock may be opened.

In electronic combination locks, when the lock is in the locked condition the connection between the dial shaft, that the dial rotates, and the bolt is normally disengaged. The rotation of the dial shaft will not cause any of the bolt withdrawal linkage to move due to the disengagement.

Unless interlocked, the bolt withdrawal linkage is subject to being displaced to a position in that the wheel may be turned and the bolt withdrawn. If this is possible, the lock could be opened in the sense of the bolt being withdrawn, even though the proper combination has not been entered. This may be possible if the lock and the enclosure are impacted in the correct direction with a force sufficient to cause the inertia of the pawl to cause the pawl to move into an engagement zone with the wheel and the wheel is quickly turned after the impact to catch and pull the pawl to withdraw the bolt into the lock housing.

Under normal lock operations as the connection of the wheel to the pawl is controlled by a very small stepper motor or similar low current, low voltage device being actuated, thus a large mass interlock is not practical. The stepper motor rotates a gear into engagement so that a larger force may be used to move the chain of parts to accomplish the engagement of the pawl with the wheel.

SUMMARY OF THE INVENTION

A small stepper motor is used to connect the wheel of the combination lock to the pawl when a signal is received from the electronic controls of the lock. The motor rotates a sector gear through a partial revolution into a relief in the wheel's outer surface to engage the gear's teeth with the teeth of a partial gear on the wheel.

The gear is provided with lost motion slots arranged to permit the rotation of the gear without displacement of a cam positioned coaxially with the gear. Further rotation of the partial gear is dependent upon the rotational movement of the dial shaft of the lock and the gear teeth of the wheel.

The manual input of force through the dial, dial shaft and wheel will rotate the partial gear; this in turn will turn the cam to pull an interposer slide. The interposer slide is connected to and pulls the pawl into a position then where the wheel may engage and force the pawl laterally to retract the bolt.

The cam is provided with an interlock pin to engage an opening in the interposer slide. The interposer slide is pulled when the cam is rotated by the dial and the interlock pin engages the opening to prevent the movement of the slide occurring when the slide and the cam are in the restored or locked position. With the pin in a position of interference with the surface defining the opening in the slide, the slide is limited in the distance it may translate under the influence of outside forces.

If the enclosure is dropped and the inertial forces of the pawl and slide are aligned with the direction of movement of the slide, the forces will tend to move the slide and pawl to a position whereby the wheel will engage the pawl. The interlock pin on the cam will block the slide from movement. The pin will prevent the slide from translating enough to allow the pawl to be engaged.

Another method of attack on a combination lock is to cut or burn through the enclosure of the safe or vault, or to degrade heat sensitive components of the lock using an oxy-acetylene torch. As the lock housing is heated, and the design threshold temperature reached, an eutectic metal plug with a precise melting point is heated above its melting temperature which allows an interlock member to obstruct the path of the slide, thereby preventing the pawl from being moved away from a blocking surface of the lock case.

OBJECTS OF THE INVENTION

An object of the invention is to prevent the opening of a locked enclosure by the use of impact on the container which then may align internal parts of the locking mechanism in order to permit the withdrawal of the lock bolt.

Another object of the invention is to interlock the bolt withdrawal mechanism of an electronic combination lock in order to prevent the bolt withdrawal except under the influence of the electronic controls of the lock.

To more fully understand how the objects of the invention are accomplished together with the structure and operation of the invention as well as how to overcome the shortcomings of the prior art, reference is made to the drawings and the detailed description of the invention below.

DRAWINGS

FIG. 3 illustrates the elements of the bolt withdrawal mechanism and interlock in the unlocked state as viewed from the front of the mechanism.

FIG. 4 illustrates the thermal protection and relock mechanism for the lock where an interlock disables the lock operability after a threshold temperature is exceeded or where the cover of the lock is displaced, in a sectional view along line 4—4 in FIG. 2.

Figure 1:
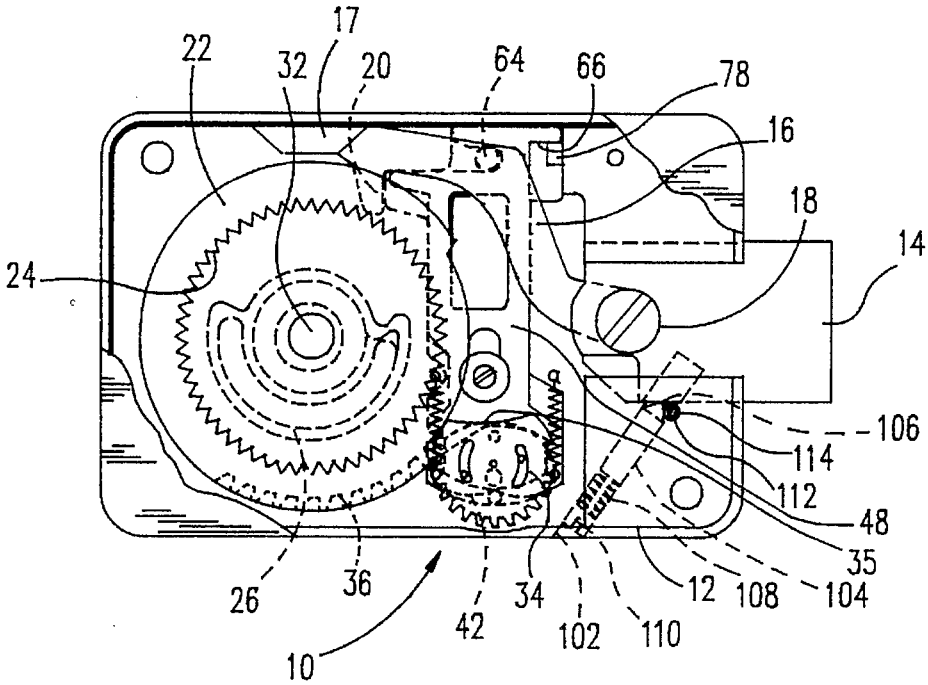
FIGS. 1 illustrates the elements of the bolt withdrawal mechanism and interlock in the locked state, as viewed from the rear of the mechanism.

Reference is made to the drawings in the following description of the best mode for carrying out the invention.

DETAILED DESCRIPTION OF THE BEST MODE FOR CARRYING OUT THE INVENTION

Like reference numerals are used to denote the same element in several different figures, even though the elements may be oriented differently.

Figure 2:
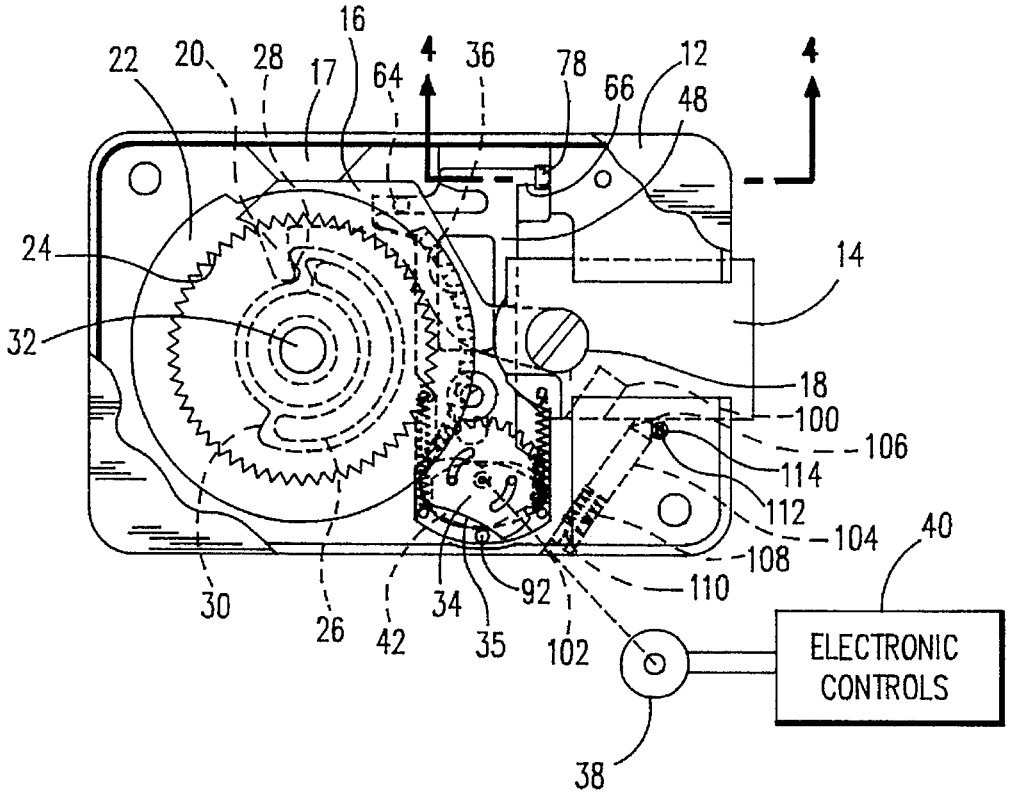
FIG. 2 illustrates the elements of the bolt withdrawal mechanism and interlock in the unlocked state, as viewed from the rear of the mechanism.
Figure 5:
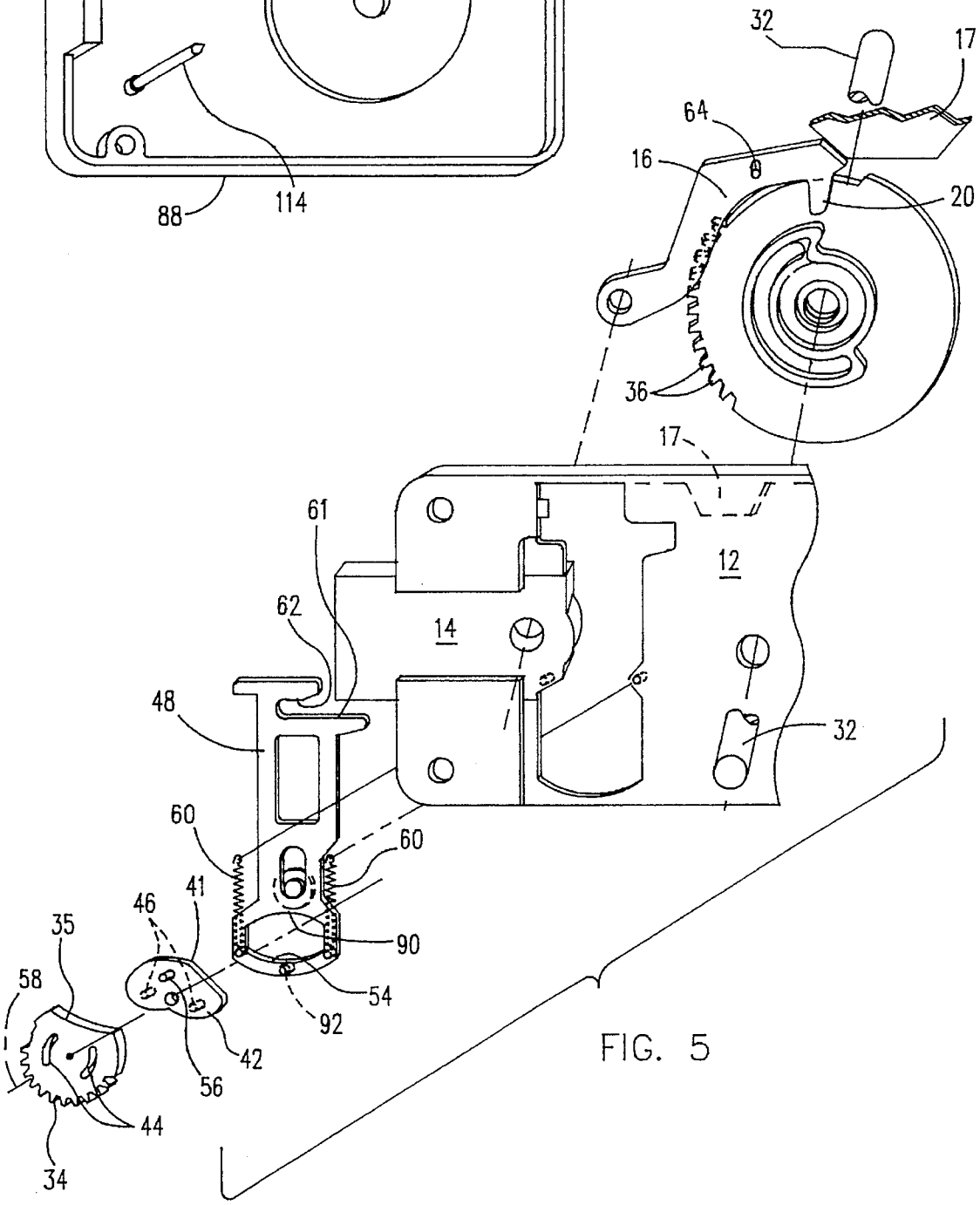
FIG. 5 is an exploded frontal view of the anti-impact interlock parts of the lock.

Referring primarily to FIGS. 1 and 2 but also to FIGS. 3 and 5, the lock 10 has a lock housing 12 which encloses the mechanism for moving the bolt 14 from an extended to a retracted position and returning the bolt 14 to an extended position.

Bolt 14 is mounted for sliding movement within housing 12. Movement of the bolt 14 is provided by pawl 16 which is connected by screw 18 to the bolt 14. Pawl 16 is formed to include pawl tip 20 which projects from pawl 16 to be engaged by wheel 22. Wheel 22 is a composite of several components to provide several functions. Interior gear teeth 24 are provided to mesh with and drive a geared input to a stepper motor 38, not shown, which electrically powers the electronic controls of the lock 10.

Wheel 22 is provided with a raised structure 26, projecting from the plane of the wheel 22 and having a partially cylindrical shape. The portion of the cylinder which remains terminates in two surfaces 28, 30 which function to deliver forces to pawl tip 20 in order to drive the pawl 16 to further move the bolt 14.

Surface 28 will engage the pawl tip 20 and, upon further rotation of the wheel 22, will pull the pawl 16 toward the left in FIG. 2; thus the bolt is translated to the illustrated withdrawn position.

Surface 30 is a restore cam surface. When the wheel 22 is reversed and the pawl 16 is in the position shown in FIG. 2, the pawl tip 20 is pushed by cam surface 30 to force the pawl 16 and bolt 14 to the right and thus extend the bolt 14.

FIG. 1 illustrates pawl 16 occupying the locked position. The tip 20 is withdrawn from the rotational path of surfaces 28 or 30. Wheel 22 will rotate with the dial, not shown, and dial shaft 32 to provide electrical power to the lock 10 and to input the combination as described in co-pending application Ser. No. 07/719,046, filed Jun. 21, 1991, by Gerald L. Dawson, et al., and commonly assigned with this application and now abandoned. As the wheel 22 rotates, it will be free of engagement by the pawl tip 20 and free from gear 34. Wheel 22 is provided with teeth 36 which will mesh with gear 34 when gear 34 is rotated into meshing relation with teeth 36 by stepper motor 38. Gear 34 has a segment removed to form a relieved region 35. When the lock 10 is in a locked state and all the parts are in their respective restored positions, the relieved portion 35 faces the periphery of wheel 22, permitting free rotation of wheel 22, and complete disconnection of the gear teeth on wheel 22 from the teeth on gear 34.

Rotation of gear 34 is accomplished by a small low voltage, low current stepper motor 38 which is activated by the electronic controls 40 of the lock 10. The rotation of the gear 34 is relatively uninhibited by outside forces such as friction or mechanical load, because the connection to cam 42 is through lost motion slots 44 and pins 46 residing on cam 42. The gear 34 is unimpeded in rotation until the ends of the lost motion slots 44 engage pins 46. This occurs only after the rotation by the stepper motor 38 is completed.

Interposer slide 48 is slideably mounted in the lock housing 12 and permitted to move relative to the housing 12. The interposer slide 48 is provided with four engagement surfaces. The first of these engagement surfaces is a follower pin 92 shown in FIG. 5. Follower pin 92 is engageable by cam surface 41 on cam 42. As cam 42 is rotated, surface 41 will rotate about axis 58 and contact follower pin 92. With continued rotation of cam 42, surface 41 will act on follower pin 90 to pull interposer slide downward against the force of restore springs 60.

The second engagement surface of interposer slide 48 is slot 62. Slot 62 engages with pin 64 found on the pawl 16. As interposer slide 48 and slot 62 move downward in response to rotation of cam 42, pin 64 is pulled downward and rotates pawl 16 around the axis of screw 18 in a counter-clockwise direction, as viewed in FIGS. 1 and 2, and in a clockwise direction as viewed in FIGS. 3 and 5. Movement of pin 64 by surface 62 presents pawl tip 20 to surface 28 as wheel 22 is rotated.

The third engagement surface of the interposer slide 48 is latch surface 66. Latch surface 66 permits latching the interposer 48 in the restored position to prevent the lock from opening under two different types of attack. The latch mechanism 70 for accomplishing this latching function is shown in FIG. 4. Latch mechanism 70 combines two forms of protection against attack on the lock 10, utilizing latch surface 66 and latch arm 78. Typical security specifications for locks of this type and level of protection provide that the lock must be rendered inoperative if the back plate of the lock housing 12 is displaced more than 0.1 inches (2.54 mm.) from the housing. Thus, instruments or devices may not be inserted into the lock housing to manipulate or position elements of the lock mechanism. Secondly, the security specifications further require that the lock be rendered inoperative if the lock temperature exceeds a predetermined temperature, 75.6 degrees C. (168 degrees F.). Engagement surface 66 will be blocked from movement if the temperature of the lock 10 exceeds 70 degrees C. threshold temperature.

These two functions are performed by the latch mechanism 70 in FIG. 4. Spring 72 is seated in the lock housing 12 and biases follower 74 upward against arm 78 of lever 76, urging arm 78 in a counter-clockwise direction.

Arm 80 of lever 76 is engaged by plunger 82 which resides in an opening 84 in housing 12. The plunger 84 is held in a displaced position, as illustrated in FIG. 4, by the cover plate 88. Within a recess in cover plate 88 is a eutectic plug 86. Eutectic plug 86 is an alloy of metals that has a precise melting point, for example, 75.6 degrees C. Plug 86 will displace plunger 82 when the cover 88 is assembled to the lock housing 12. The displacement of plunger 82 results in rotation of arm 78 out of a position of interference with surface 66 of interposer slide 48 and arm 80 being held in the displaced position.

Should eutectic plug 86 reach the melting temperature of the plug 86, the metal will turn to liquid and plunger 82 will not be resisted by plug 86; this allows the follower 74 to move under the influence of spring 72 to a position forcing arm 78 to a blocking position with respect to surface 66. With arm 78 in a blocking position, interposer slide 48 can not be moved to an unlocking position by any means, short of destroying the lock 10.

The fourth engaging surface of the interposer slide is surface 90, best seen in FIG. 5. Surface 90 is the upper surface of the opening which forms surface 54. Pin 56 will engage the surface 90 if the interposer slide 48 is caused to displace downward against the forces of the restore springs 60, while lock 10 is locked, without the rotation of cam 42.

This condition would exist when interposer slide 48 is moved but the stepper motor 38 is not energized to permit the unlocking of lock 10.

The lower surface 61 of slot 62 is acted upon by pin 64, thereby holding slide 48 in the down or displaced position when the lock 10 is unlocked. This prevents the slide 48 from interfering with the restoration of the gear 34 or the cam 42.

When a drive signal is received by the stepper motor 38 from the electronic controls 40 indicating that the lock 10 is to open, the stepper motor 38 rotates gear 34 a partial revolution and presents the teeth of gear 34 to the teeth 36 of wheel 22. Rotation of wheel 22 by dial shaft 32 then will rotate gear 34 and reduce any play in the lost motion slots 44 to engage the lost motion slots 44 of gear 34 with pins 46 on cam 42. Further rotation of dial shaft 32 then will rotate cam 42 until it pulls interposer slide 48 downward by the action of cam 42 on follower pin 92. The downward motion of interposer slide 48 displaces pawl 16 presenting pawl tip 20 to surface 28 and permit still further rotation of wheel 22, thereby pulling on pawl tip 20 to translate bolt 14 to its withdrawn position.

Restoration of the bolt 14 to its extended, locked position is accomplished by reverse rotation of the wheel 22 by the dial shaft 32. As wheel 22 rotates in the reverse or locking direction, surface 30 will engage pawl tip 20 and push pawl 16 and bolt 14 rightward to the locked position. As pawl 16 is pushed by surface 30, it will clear stop 17 and the forces of the restore springs 60 will restore the interposer slide 48 and the pawl 16 to their respective locked positions.

The restore movement of the dial shaft 32, acting through wheel 22, will rotate gear 34 to a position where the relieved segment 35 of the gear 34 is presented to the periphery of wheel 22. This disengages the gear 34 from the wheel 22 and permits the movement of wheel 22 without any action or motion being transferred to cam 42.

With all parts restored, the pin 56 on cam 42 is positioned closely to surface 90. Should the enclosure be raised from the floor and then dropped, upon impact of the enclosure with the floor, the inertia of the pawl 16 and interposer 48 displace pawl 16 and interposer 48 downward relative to the lock housing 12. Pin 56 will then engage surface 90 to block further movement of interposer 48, causing a block restricting further movement of pawl 16.

As can be seen from the foregoing description, the lock 10 may not be defeated by impacting the enclosure with a significant force, such as dropping the enclosure on a floor or solid surface and rotating the dial shaft 32 very quickly after impact in the hope of catching pawl tip 20 on surface 28 and pulling pawl 16 toward an unlocked position past stop 17.

If heat such as a cutting torch is used to attack the enclosure or the lock 10, the heat will be transmitted through the lock housing 12; the eutectic plug 86 will melt sharply at the predetermined temperature releasing arm 78 to enter the path of surface 66 of interposer 48, preventing movement of the interposer 48 necessary to unlock the lock 10.

The interlock system addresses three different modes of attack on the lock 10; it prevents both impact and thermal attack from being successful, as well as it displaces the lock housing back plate 88 to gain access to the lock works and any successful repositioning of the lock works elements.

As an additional safeguard against the partial removal of the back plate 88 and the possible insertion of a tool or device to force the bolt 14 toward the retracted position, a relock interlock is actuatable to permanently block the bolt 14 in an extended position. Referring to FIGS. 1 and 2, the bolt 14 is provided with a recess 100 oriented so that the recess axis lies in a plane parallel with the largest plane surfaces of the bolt 14 and lying at an angle to the axis of movement of the bolt 14. The lock housing 12 is provided with a bore 102 or channel 102 formed or drilled therein at the same orientation as the recess 100 in the bolt 14. Within the bore 102 is positioned a plunger 104 with a rounded nose 106. The plunger 104 is biased by a spring 108 in compression, positioned behind the plunger 104. A threaded plug 110 is inserted into the bore and tightened to retain the spring in compression against the plunger 104.

Figure 6:
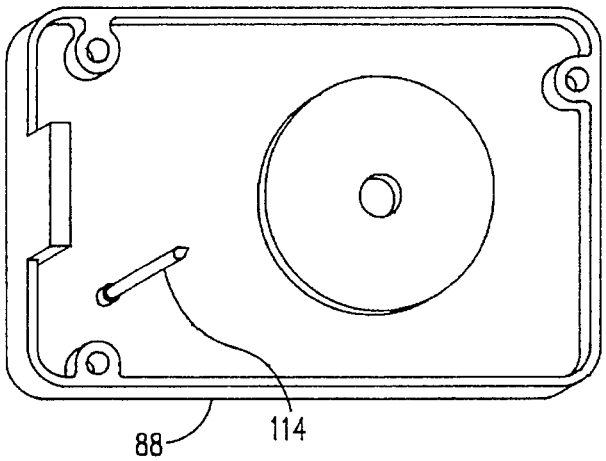
FIG. 6 is an illustration of the lock housing cover with an interlock retaining pin projecting therefrom.

In order to retain the plunger 104 in a retracted, ineffective position, a hole 112 is drilled or formed into the lock housing 12, perpendicular to and intersecting at least a portion of the bore 102, to receive a pin. The cover plate 88 is provided with a pin 114, best seen in FIG. 6, positioned on the cover plate 88 to fit into the hole 112 when the cover plate 88 is assembled to the lock body 12. The pin 114 is long enough to extend to at least the intersection of the bore 102 and the hole 112, thereby protruding at least partially into the bore 102. The pin 114 extending into the bore will block the movement of the plunger 104 along the bore 102 and into the recess 100 in the bolt 14. The pin length may be tailored to any length that will release the plunger 104 upon any given amount of back plate 88 displacement from the lock housing 12.

When the plunger 104 is released, it is moved by the spring 108 to project into the recess 100. The components of movement of the plunger 104 are perpendicular to and parallel to the axis of movement of the bolt 14. The component of movement which is parallel to the axis of the bolt movement is in the direction of the bolt movement when translating to the extended bolt position.

Should the bolt 14 be forced toward a retracted position while or after the back plate 88 is displaced and the plunger is in the extended position bridging the recess 100 in bolt 14 and bore 102 in the lock housing 12, plunger 104 must be sheared to permit the movement of the bolt 14. The angular orientation of the plunger 104 insures that the attempted movement of the bolt 14 will bind the plunger 104, rather than urge it against the spring 108.

Once this relock device is actuated, the lock 10 must be disassembled in order to restore the plunger 104 to the retracted, ineffective position. Accordingly, the displacement of the cover plate 88 will activate both the blocking member 78 and the plunger 104 but the reassembly of the cover plate 88 will not restore the plunger 104 as it will the blocking member 78.

While the preferred embodiment of the best mode of carrying out the invention has been described above, it is understood that changes and modifications may be made within the scope of the invention as set forth in the claims appended hereto, without departing from the scope or spirit of the invention.

We claim:

1. An interlock comprising:

a bolt having two positions, one of said positions being an extended position and another of said positions being a withdrawn position;

a linkage connected to said bolt for transmitting force to said bolt to move said bolt from one of said positions to said other of said positions, said linkage having two positions relative to said bolt, one of said positions being a position ineffective to receive said force and said other of said positions being a position effective to receive said force;

bolt moving means for providing said linkage said force to move said bolt;

an interposer for displacing said linkage from said ineffective position to said effective position, said linkage disengageable from said interposer only upon movement of said linkage and said bolt to said withdrawn position;

means for manually inputting a force to said lock;

a rotary member rotationally driven by said means for manually inputting a force to transmit said input force to said interposer;

electromagnetic means for selectively connecting said means for manually inputting a force to said rotary member;

a displaceable blocking member for preventing said interposer from displacing said linkage, said displaceable blocking member directly blockingly engageable with said interposer to block said interposer from movement and displaceable by said rotary member to a position out of engagement with said interposer;

said blocking member further comprises displacing means for moving said blocking member out of engagement with said interposer.

2. The interlock of claim 1 wherein said blocking member is selectively removable from engagement with said interposer when said lock is selectively conditioned to be opened.

3. The interlock of claim 2 wherein said blocking member comprises a pin, said pin driven from a position of engagement to a position of disengagement by said rotary member.

4. The interlock of claim 3 wherein said electromagnetic means comprises a stepper motor, and said displacing means comprises a gear comprising teeth and a secondary driving connection, a rotatable member driven by said secondary driving connection, said rotatable member carrying said pin.

5. The interlock of claim 1 further comprises a force transmission member acting on said blocking member to move said blocking member to a first position disengaged from said interposer, and a biasing means for urging said blocking member to a second blocking position in the path of movement of said interposer for engagement with said interposer to prevent movement of said interposer.

6. The interlock of claim 5 wherein said lock further comprises a lock housing and a lock housing cover attachable to said lock housing;

said lock housing cover engageable with said force transmission member to displace said force transmission member to a displaced position when said lock housing cover is attached to said lock housing, whereby said force transmission member displaces said blocking member to said first position.

7. The interlock of claim 6 wherein said lock housing cover further comprises a solid metal alloy insert.

8. The interlock of claim 7 wherein said force transmission member engages said solid metal alloy insert.

9. The interlock of claim 7 wherein said insert comprises an eutectic alloy with a well-defined melting temperature, whereby upon the heating of said insert to a temperature at or above said melting temperature, said force transmission member will no longer be engaged by said insert and said biasing means acting through said blocking member will move said force transmission member to an undisplaced position and said blocking member will assume a position in the path of movement of said interposer blocking said interposer and preventing said linkage from being displaced from said ineffective position to said effective position.

10. A lock having an anti-attack interlock comprising:

a bolt having two positions, one of said positions being an extended position and another one of said positions being a withdrawn position;

a linkage connected to said bolt for transmitting force to said bolt to move said bolt from one of said positions to said other of said positions, said linkage having two positions relative to said bolt, one of said positions being a position ineffective to receive said force and another of said positions being a position effective to receive said force;

an interposer slidably disposed to transmit a driving force to said linkage to displace said linkage between said ineffective and effective positions;

a manual force input selectively drivingly connectable with a cam;

said cam disposed to slidably translate said interposer from said ineffective position to said effective position responsive to said manual force input;

a displaceable blocking member disposable in a blocking relation to and directly engageable with said interposer to prevent said interposer from permitting displacement of said linkage and removable from blocking relation to said interposer in response to rotation of said cam, upon said lock being selectively conditioned to be opened;

an electromagnetic means for controlling said interposer, wherein said blocking means comprises a pin; said pin selectively driven from a blocking relation to a position removed from a blocking relation to said interposer responsive to electromagnetic means, said electromagnetic means comprises a stepper motor, said said electromagnetic means for controlling said interposer further comprising a gear engageable with said manual force input and having a secondary driving connection to said cam.

11. The lock of claim 10 wherein said lock further comprises a force transmission member acting on a second blocking member to move said second blocking member to a first position disengaged from said interposer, and a biasing means for urging said second blocking member to a second blocking position in the path of movement of said interposer for engagement with said interposer to prevent movement of said interposer, under predetermined conditions.

12. The lock of claim 11 wherein said lock further comprises a lock housing and a lock housing cover attachable to said lock housing;

said lock housing cover engageable with said force transmission member to displace said force transmission member to a displaced position when said lock housing cover is attached to said lock housing, whereby said force transmission member displaces said blocking member to said first position.

13. The lock of claim 12 wherein said lock housing cover further comprises a solid metal alloy insert.

14. The lock of claim 13 wherein said force transmission member engages said solid metal alloy insert.

15. The lock of claim 13 wherein said insert comprises an eutectic alloy with a well-defined melting temperature, whereby upon the heating of said lock and said insert to a temperature at or above said melting temperature, said force transmission member will no longer be engaged by said solid insert and said biasing means acting through said blocking member will move said force transmission member to an undisplaced position and said blocking member will assume a position in the path of movement of said interposer, blocking said interposer and preventing said linkage means from being displaced from said ineffective position to said effective position.

* * * * *